US007516688B2

(12) United States Patent
Raczykowski

(10) Patent No.: US 7,516,688 B2
(45) Date of Patent: Apr. 14, 2009

(54) SAW CHAINS HAVING HARDENED CUTTING ELEMENTS

(75) Inventor: Daniel G. Raczykowski, Spokane, WA (US)

(73) Assignee: Unifire Power Blowers, Inc., Spokane, WA (US)

( * ) Notice: Subject to any disclaimer, the term of this patent is extended or adjusted under 35 U.S.C. 154(b) by 51 days.

(21) Appl. No.: 11/117,992

(22) Filed: Apr. 29, 2005

(65) Prior Publication Data

US 2006/0243097 A1 Nov. 2, 2006

(51) Int. Cl.
*B27B 33/14* (2006.01)

(52) U.S. Cl. ..... 83/830; 83/835; 30/381; 407/113

(58) Field of Classification Search ..... 30/381, 30/349–351, 353, 356, 357; 83/835, 830–834; 407/113, 114

See application file for complete search history.

(56) References Cited

U.S. PATENT DOCUMENTS

| | | | | |
|---|---|---|---|---|
| 417,468 | A | 12/1889 | Brooke | |
| 834,251 | A | 10/1906 | Bailey | |
| 2,976,900 | A * | 3/1961 | Mills | 83/834 |
| 3,071,027 | A | 1/1963 | Hilsebrand | |
| 3,292,675 | A | 12/1966 | Bullard | |
| 3,733,934 | A | 5/1973 | Stevenson | 76/112 |
| 4,497,232 | A * | 2/1985 | Scott et al. | 83/831 |
| 4,606,253 | A | 8/1986 | Weigel | |
| 4,762,044 | A | 8/1988 | Kolve | |
| 4,813,323 | A | 3/1989 | Harfst | |
| 4,841,824 | A | 6/1989 | Hartmann et al. | |
| 4,848,205 | A | 7/1989 | Suzuki et al. | 83/853 |
| 4,885,968 | A | 12/1989 | Tuomaala | |
| D320,543 | S | 10/1991 | Gilbert | |
| 5,056,395 | A | 10/1991 | Sovak et al. | |
| 5,257,568 | A | 11/1993 | Nitschmann | |
| 6,112,632 | A | 9/2000 | Buchholtz et al. | |
| 6,374,716 | B1 | 4/2002 | Weber et al. | |
| 2002/0050196 | A1 * | 5/2002 | Fluhrer et al. | 83/13 |
| 2003/0010178 | A1 | 1/2003 | Trimpe et al. | |

FOREIGN PATENT DOCUMENTS

| | | |
|---|---|---|
| FR | 1104456 | 11/1955 |
| GB | 2376659 | 12/2002 |

* cited by examiner

*Primary Examiner*—Kenneth E. Peterson
*Assistant Examiner*—Phong Nguyen
(74) *Attorney, Agent, or Firm*—Randy A. Gregory; Gregory IPL, P.C.

(57) ABSTRACT

Hardened cutter elements commonly called cutters used in saw chains to act as cutter links. The hardened cutters have hard insets applied and connected to the cutting face of the cutter. The insets are made of a hard, tough material, such as a suitable carbide. Also shown are saw chains having the hardened cutter links with the hard insets. The preferred insets include a rear portion having a semi-cylindrical attachment surface. The attachment surface is configured for attachment to a filed or ground cutting face of a conventional saw chain cutter. A front portion of the inset has a cutting face which is provided with beveled cutting face corners and preferably chamfered edges extending rearwardly from the inset cutting face. Methods of producing the cutters with insets and for producing saw chains with the hardened cutters are also described.

15 Claims, 8 Drawing Sheets

SAW CHAINS HAVING HARDENED CUTTING ELEMENTS

TECHNICAL FIELD

The present invention relates to saw chains used on chain saws having hardened cutting elements and related methods, such as methods for producing such saw chains and components thereof.

BACKGROUND OF THE INVENTION

Chain saws are commonly used for cutting wood. Although chain a saws are frequently used for the cutting of wood, they are also used to perform many other cutting tasks. For example, chain saws can be used for cutting other materials. In some applications, such as firefighting, it is common for chain saws to be used for cutting wood, nails, metals, concrete, tile, and other relatively hard materials in an emergency situation. These hard materials are encountered when a chain saw is used to cut through floors, walls or other structural components in responding to a fire.

As a chain saw is used, the cutting members of the saw chain will typically wear down quickly and require frequent sharpening. This is true even with relatively soft materials, such as soft woods. It is a much greater problem when cutting harder materials. Even the mere striking of nails or screws while cutting through wooden wall or floor structures is very derogatory and can immediately dull a saw chain. When the saw chain cutting members become dull, the chain saw is temporarily taken out of service so that the cutting members can be resharpened.

The amount of wear exhibited by the saw chain, and the frequency at which such resharpening is required will vary depending on the demands placed on the saw chain. The required frequency of resharpening also depends on the construction and quality of the saw chain. Unfortunately, the cutting members of conventional saw chains tend to become dull quickly under easy conditions in wood, and they dull extremely fast when materials other than wood are encountered.

There has long been a need for a saw chain which is more resistant to wear and dulling, which is convenient and cost effective to manufacture, and which reduces the expenses associated with saw chain sharpening and other maintenance. This need has been especially acute for those who use saw chains for the cutting of materials other than wood or those who encounter rocks, soil or other material while cutting wood.

In an effort to meet this need, some saw chains having carbide cutting teeth have been produced. These saw chains have satisfied some of the aforementioned needs, but unfortunately the production of such saw chains requires expensive production techniques, such as manually affixing of each cutting element. Such saw chains are also expensive to maintain due to frequent breakage of the hardened cutting elements. Breakage and dislodgement of the hardened cutting elements has severely impeded their acceptance in the market for saw chains.

A need thus remains for a saw chain with increased resistance to breakage, general wear and extreme dulling and which is economical to produce and maintain. These and other benefits may be provided by the novel features and aspects of the inventions described herein.

BRIEF DESCRIPTION OF THE DRAWINGS

Preferred forms or embodiments of the inventions are explained and characterized herein, often with reference to the accompanying drawings. The drawings also serve as part of the disclosure of the inventions made in the current application. Such drawings are briefly described below.

DETAILED DESCRIPTION OF THE PREFERRED EMBODIMENTS

Introductory Note

The readers of this document should understand that the embodiments described herein may rely on terminology used in any section of this document and other terms readily apparent from the drawings and language common therefor. This document is premised upon using one or more terms with one embodiment that may also apply to other embodiments for similar structures, functions, features and aspects of the invention. Wording used in the claims is also descriptive of the invention and the text of the claims is incorporated by reference into the description entirely in the form of the claims as originally filed. Terminology used with one, some or all embodiments may be used for describing and defining the technology and exclusive rights associated herewith.

Chain Saw

Figure 1:
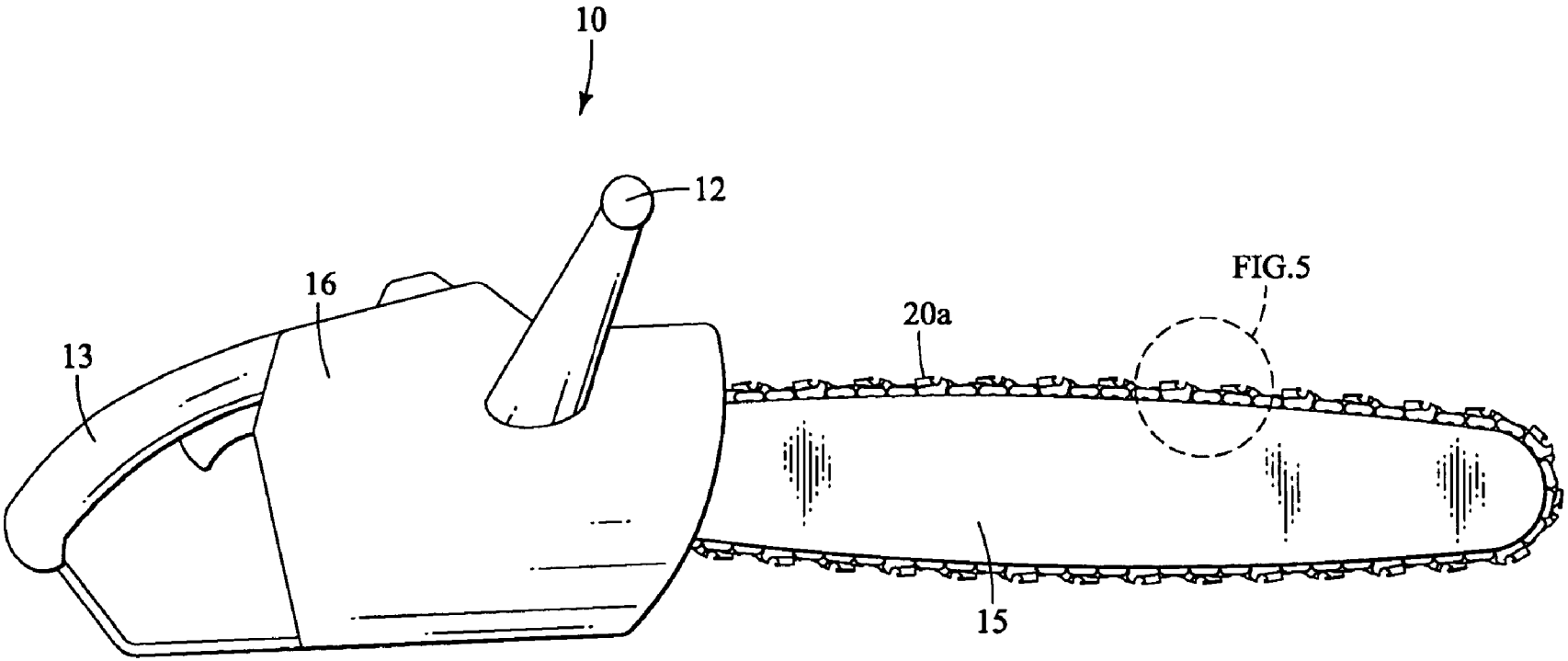
FIG. 1 is a side view of a chain saw according to one embodiment of the present invention.

Referring to FIG. 1, a chain saw is generally indicated by the numeral 10. Because most of the components of chain saw 10 and the operation are known, such will not be described in detail herein. Instead, the paragraphs of this section are intended to provide a brief introduction and orientation for a reader who is unfamiliar with chain saws and their components.

FIG. 1 shows chain saw 10 including a front handle 12 and a rear handle 13 by which a user can grasp the chain saw during operation. A cutting bar or guide bar 15 extends outwardly and forwardly from the engine, controls and most remaining parts of chain saw 10. Chain saw 10 includes an engine (not specifically shown) which is mounted inside of a housing 16. A saw chain 20*a* is guided by and trained about cutting bar 15. The cutting bar may be selected from a variety of prior designs or be constructed using suitable designs hereafter developed.

In operation, the engine and drive mechanism of the chain saw cause the saw chain 20*a* to move in a circuitous manner. The saw chain travels along the periphery of the cutting bar 15 so that the cutting members of the flexible saw chain 20*a* are supported and can be used to cut through various materials. In this document, the numeral 20 will be used to refer to conventional saw chains (FIG. 2 or 3), while the numeral 20*a* (FIGS. 1 and 5) is used herein to refer to a preferred saw chain which has been constructed according to this invention and has carbide cutter elements or other suitable hard cutter inserts or other elements made in accordance with the invention. Such are described in greater detail below.

Saw Chain

Figure 2:
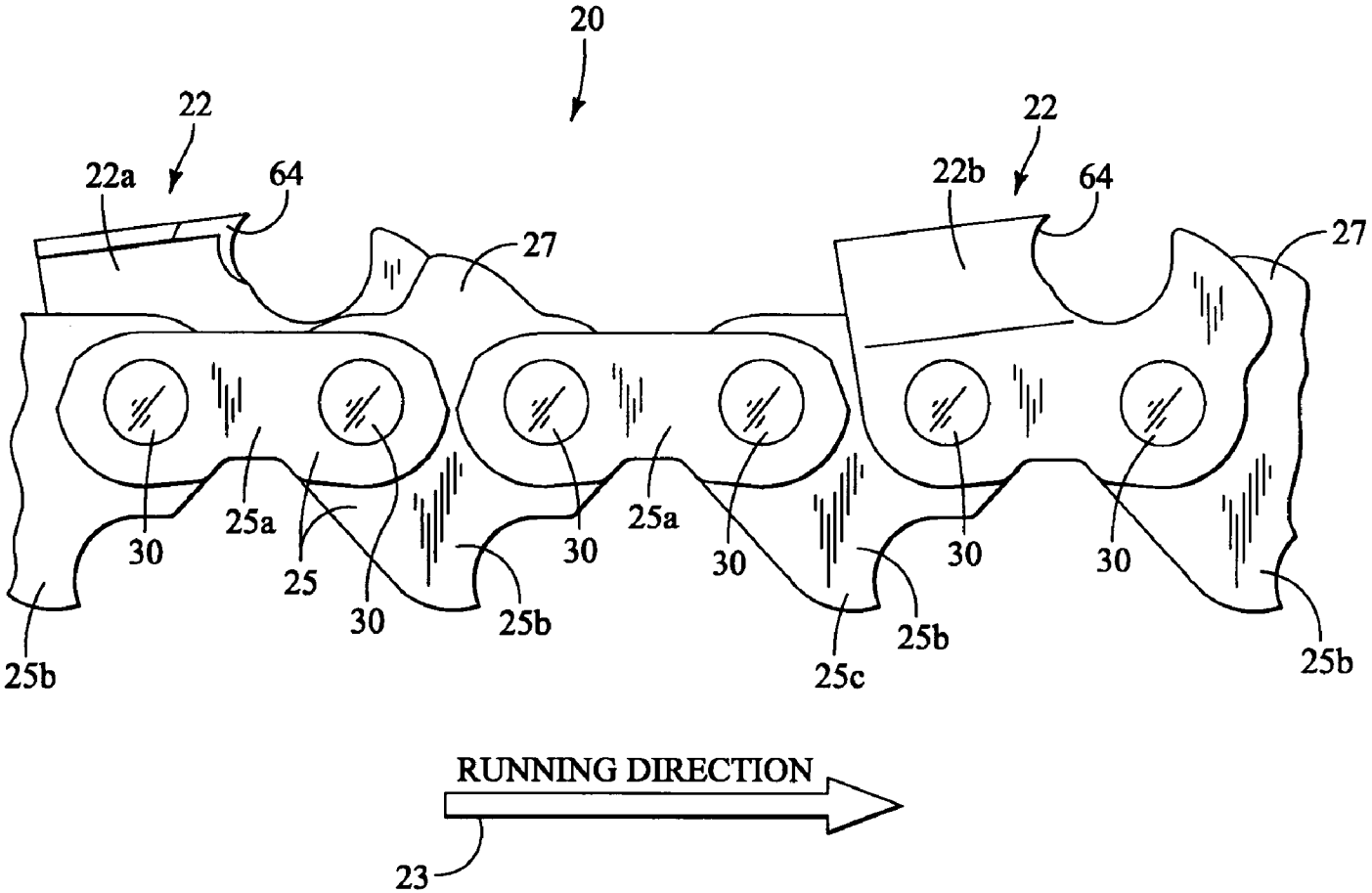
FIG. 2 PRIOR ART
FIG. 2 is a side view showing a segment of a conventional saw chain as known in the prior art.

Turning now to FIG. 2, a segment of a conventional saw chain is generally indicated by numeral 20. Saw chain 20 includes a plurality of cutting members or cutting links 22 which are often referred to simply as cutters. The cutters are typically heterochirally arranged along the saw chain 20 so that one is directed to have a cutting point along one side of the drive link and the next cutter has a cutting point on the other side. Typically the cutters have angled cutting faces that direct cuttings across the chain.

FIG. 2 shows cutting members 22 commonly referred to as left-hand cutting members 22*a*, while the oppositely oriented are referred to as right-hand cutting members 22*b*. Cutting members 22 are of opposite hand, but are typically of similar construction having an inverse relationship of component features.

Figure 2A:
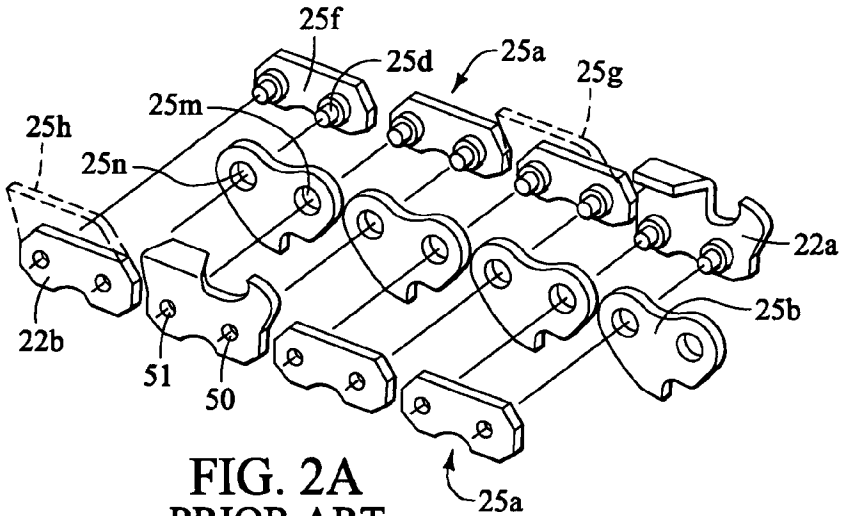
FIG. 2A PRIOR ART
FIG. 2A is an exploded, perspective view illustrating features of common saw chain construction.
Figure 2B:
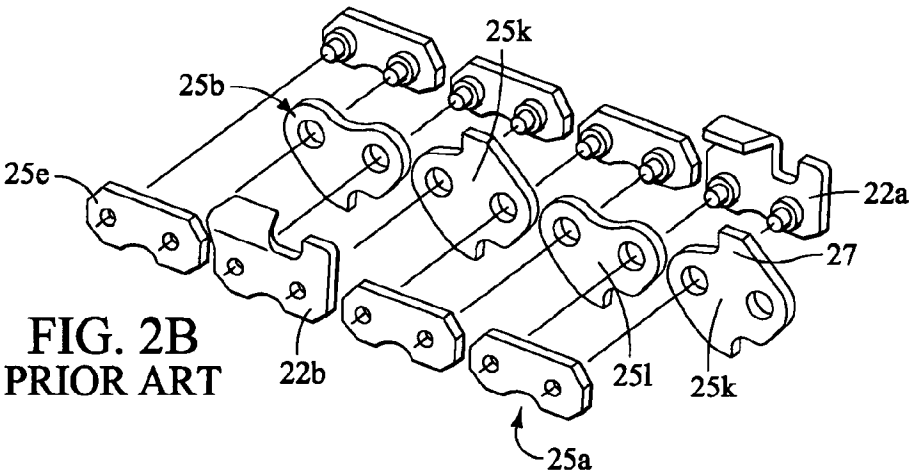
FIG. 2B PRIOR ART
FIG. 2B is an exploded, perspective view illustrating another common saw chain construction.
Figure 4:
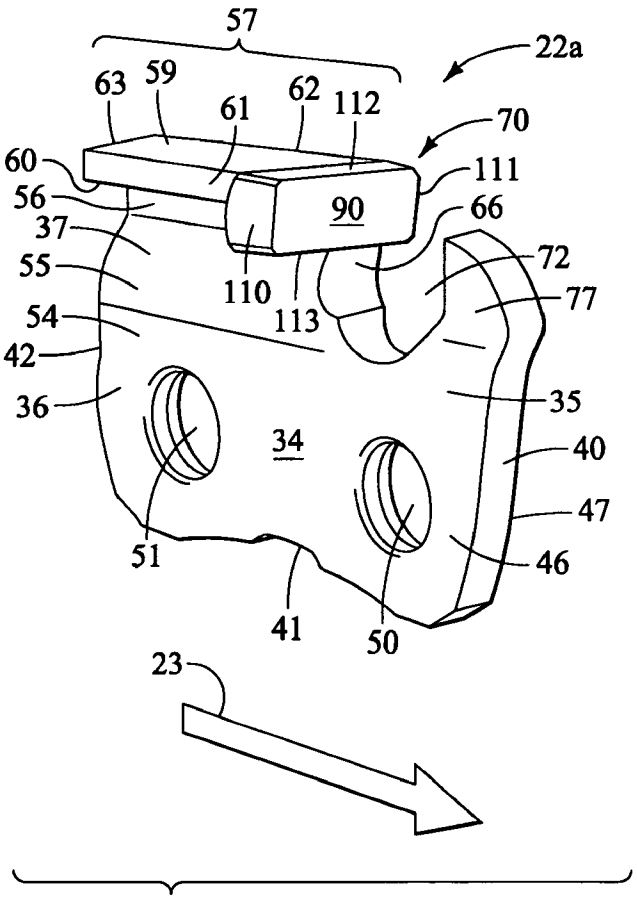
FIG. 4 is a perspective view showing a saw chain cutting member according to one embodiment of the present invention.

FIGS. 2, 2A and 2B show that cutting members 22 are connected to other links of the saw chain. FIGS. 2A and 2B show segments of saw chains exploded to better illustrate the various links and their construction. Some of the links 25 are connecting links or tie straps 25*a*, while others are drive links 25*b*. The drive links 25*b* may vary in that some of the drive links 25*b* may include a bumper 27, while other drive links may not include a bumper. Alternatively, the drive links 25*b* may all be the same throughout without bumpers.

Tie links commonly called tie straps 25*a* are used along both sides of the saw chain except where a cutter is placed. The tie straps are typically made using two different types of links. Preset tie straps 25*f* have projecting pivot studs 25*d* which extend through holes in the adjoining drive links 25*b*. Studs 25*d* also extend where appropriate through holes 50, 51 in the cutters. Where there are not cutters, the preset tie strap studs also are received through holes in opposing common tie links or tie straps 25*e*. The pivot studs are thus installed through the drive links and opposite tie straps 25*e* and then upset to form rivets.

The drive links are connected by the preset tie straps and mating common tie straps while allowing relative pivotal action so that the chain can conform to the curved guide bar periphery. The saw chain also is curved and trained about a drive gear (not illustrated) within the chain saw housing 16. Depending tangs 25*c* of the drive links 25*b* are typically received in a guide bar groove (not illustrated) that extends about the periphery of the guide bar adjacent to contacting areas against which the saw chain bears and is guided. The guide bar may include a distal end or tip which includes a guide bar sprocket (not shown) or the guide bar tip may merely be provided with a guide bar groove or channel.

FIG. 2A also shows another type of tie strap or link commonly called a preset bumper tie strap 25*g* which is shown in dashed lines. The higher profile of optional preset bumper tie strap 25*g* is shown in dashed lines. Bumper tie strap 25*g* is used to provide added support of the saw chain within a cutting groove or saw kerf to reduce concentration of forces upon the cutter 22*a*. The preset bumper tie strap 25*g* has pivot studs 25*d* as described above.

FIG. 2A further shows another type of common tie strap or link 25*h*. Link 25*h* is also shown with the higher bumper profile in dashed lines indicating the optional nature of such a link. The common bumper tie strap 25*h* does not have pivot studs 25*d*, but instead has holes similar to holes 50 and 51 of cutter 22*b* for receiving studs 25*d* of the opposing preset tie strap 25*f*.

FIG. 2B shows a somewhat different saw chain construction which is similar to that shown in FIG. 2A with differences explained below. The drive links 25*b* of FIG. 2*b* also may include bumper drive links 25*k* having bumper extensions 27 as mentioned above and also shown in FIG. 2. The bumper drive links may be provided at various frequencies or spacings along the saw chain. The bumpers 27 on bumper drive links 25*k* are used to reduce concentration of force upon the cutters as they saw down within a saw kerf.

Both the regular drive links 25*l* and bumper drive links 25*k* have first and second apertures 25*m* and 25*n*. The pivot studs 25*d* of the preset tie links 25*f* extend through the apertures 25*m* and 25*n* of the drive links.

Conventional Cutting Member

Figure 3:
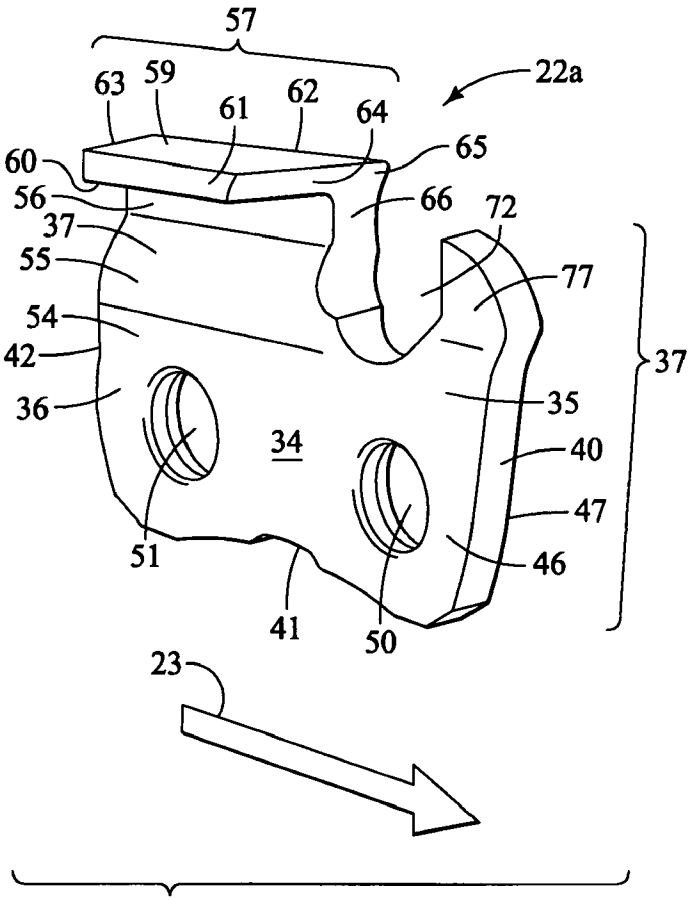
FIG. 3 PRIOR ART
FIG. 3 is a perspective view of a saw chain cutting member, commonly called a cutter, as known in the prior art.

Referring to FIG. 3, the structure of the cutting members or cutters 22 are now described in detail. As mentioned above, the left-hand and right-hand cutting members 22*a* and 22*b* are of similar construction and are of opposite hand. Therefore, a description of one cutter 22 will act to adequately describe both left-hand and right-hand cutters. The cutting member 22*a* shown in FIG. 3 and described below is a left-hand cutter. The running direction of the cutter 22*a* is indicated by movement arrow 23.

Cutter 22*a* includes a cutter body 34. Cutter body 34 preferably includes a side plate portion 37 and top plate portion 57. The side plate portion of the cutter body is preferably integrally formed with the top plate portion to provide toughness to handle the impactive forces experienced by the cutter during operation. Together the side plate and top plate make up the cutter body. The cutter body 34 includes a front portion 35 and a rear portion 36. The cutter body 34 is defined in part by a leading edge 40, a lower edge 41, and a trailing edge 42. The side plate portion of cutter body 34 is also defined in part by an inner face 46 and an outer face 47.

A front or first aperture 50 and a rear or second aperture 51 which extend through the cutter body 34, and are configured to receive studs 25*d*, pins or rivets 30 which serve to connect the cutter 22*a* to the saw chain 20 drive links 25*b* and opposing tie straps. The opposing tie straps are typically preset tie straps that extend through holes in two adjacent drive links, such as through holes 50 and 51. The pivot studs 25*d* are then upset to form rivets 30.

Referring still to FIG. 3, the rear portion 36 of the cutter body 34 is generally shaped as shown. The rear portion 36 of the cutter body 34 includes a lower portion 54, a mid-portion 55, an upper portion 56, and top plate 57. Top plate 57 is defined in part by an upper surface 59, a lower or under surface 60, an inner edge 61, an outer edge 62, a rear edge 63, and a tooth face 64 having a cutting point 65. A cutting face 66 extends downwardly from the horizontal cutting face 64. When formed, the top cutting face and vertical cutting face are ground, filed or otherwise formed. This is advantageously done using a round file, rotating grinder tool, or other cutting face former that produces a partial cylindrical or semi-cylindrical face upon both the front faces of the upper plate and adjacent portions of the vertical plate. The resulting partial cylindrical cutting face is obliquely angled at a filing angle that varies with different saw chain cutter designs. Filing angles are in the range of 20°-40°, more preferably 25°-35°.

The front portion 35 of the cutter body 34 preferably extends upwardly to form a depth limiter or depth gauge 77 which in operation controls or limits the depth of the cut which is made by the cutting member 22. The depth limiter is preferably a ramped depth gauge which slopes from the front 40 toward gullet 72. The space between the front part of the cutter, such as depth gauge 70, and the vertical cutting tooth 66 forms a recessed gullet 72. The gullet serves to facilitate chip removal during cutting with the saw chain.

Cutter Inset

Referring to FIGS. 4-8, a cutter inset, insert or other element according to a preferred embodiment of the present invention is generally indicated by the numeral 70. The cutter insert 70 preferably is made of a suitable carbide or other hardened wear part material as now known or hereafter developed. Materials believed suitable include cemented carbides. Many cemented carbides are produced by powdered metallurgy techniques. Cemented carbides which may be useful in the invention may be produced by sintering, casting, flame spraying and arc deposition, depending on the economies and particular materials used to produce the carbides or other hardened wear part material.

Examples of hardened wear part materials which may be useful alone or in combinations include tungsten carbide, titanium carbide, tantalum carbide, chromium carbide and silicon carbide. Other hard facing materials may be suitable, including currently available materials or materials developed hereafter. Typically tungsten carbide is now most available, economical and provides desirable mechanical properties and wear resistance, thus it is currently preferred. Mixtures of such carbides in various proportions may also be suitable depending on the mixture being selected.

A preferred formulation found useful in this invention is a grade C-11 tungsten carbide (87%) with cobalt binder (13%). This formulation provides a hardness on the Rockwell A scale of approximately 88.5±0.5. The approximate density is 14.20±0.1 grams/cubic centimeter. Transverse rupture strength of approximately 460,000 pounds per square inch is provided with this formulation. Other formulations which provide good wear resistance and toughness to resist breakage of the cutting element may also be suitable in constructions according to this invention.

Various binder materials may be used to produce the cemented carbides or other hardened cutting element materials. Other suitable materials may include cobalt, nickel, titanium carbide, tantalum carbide, tungsten carbide, and other materials which are now known or hereafter developed to aid or act as binder materials.

The carbide cutter element 70 is advantageously configured so that it can be attached to a conventional saw chain 20 as described in detail below. The cutter element or insert 70 of the present invention offers several advantages. For example, there is no need to grind, machine, or otherwise modify the conventional saw chain 20 (FIG. 2) in preparation for, or prior to, attachment of the cutter inset 70, as the cutter inset 70 can be easily attached to a suitable cutter which has a concave semi-cylindrical filing receptacle 64, 66 for an off-the-counter saw chain 20. This does not require special preparation and can be used on various sizes of chain chassis, such as 7/32 inch, 6/32 inch, 3/32 inch and others. In addition, there is no need for grinding of the inset after the cutter inset has been attached.

Figure 6:
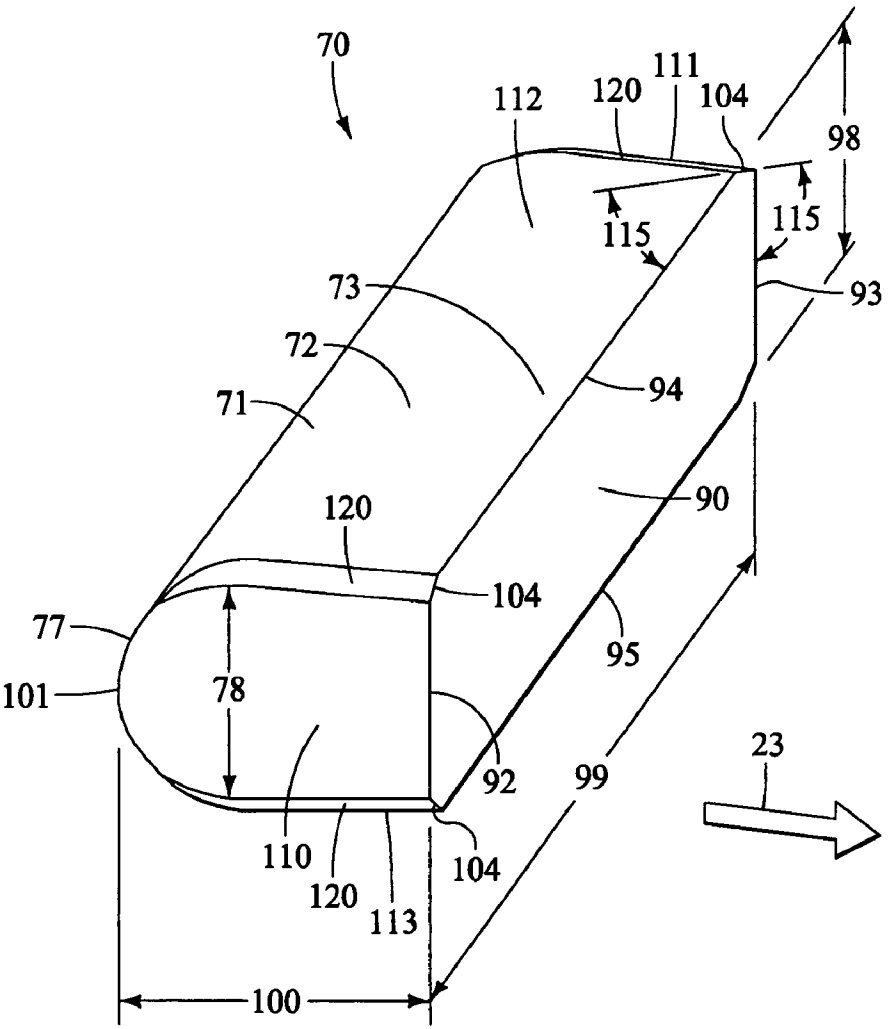
FIG. 6 is a perspective view showing a preferred cutter element according to one embodiment of the present invention.
Figure 7:
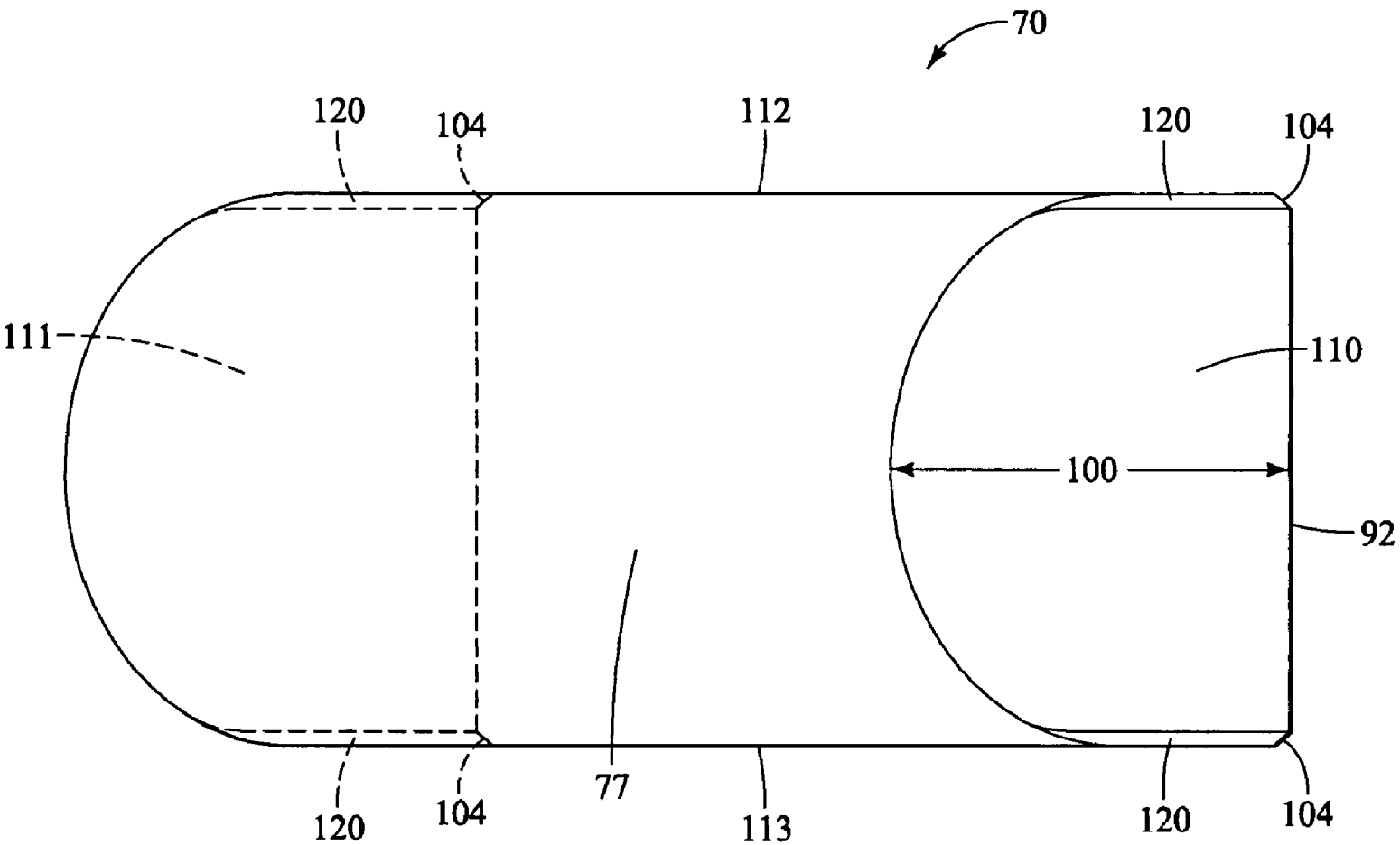
FIG. 7 is a side view showing the cutter element of FIG. 6.

FIG. 6 shows the cutter inset 70 has a rear portion 71, a body portion 72, and a front portion 73 as described further below. Although the viewpoint of FIG. 6 creates an illusion the inset is rectangular, the filing angle still exists.

Rear Portion—Cutter Inset

The rear portion 71 of the carbide cutter inset 70 includes a convex semi-cylindrical surface 77 which is sized and configured for attachment to the semi-cylindrical concave portion of tooth face 64 (see FIGS. 2 and 3) of a suitable conventional saw chain cutting member 22. In one implementation, the curvature of the tooth face 64 of the conventional saw chain cutting member 22 is about 7/32 inch in diameter. The diameter of the semi-cylindrical attachment surface 77 is about 6/32 inch, as shown by arrow 78, to facilitate attachment of the cutter inset 70 to the tooth face 64 of the conventional saw chain cutting member 22. The semi-cylindrical attachment surface 77 can therefore be positioned within the semi-cylindrical tooth face 64 for attachment thereto.

The cutter inset 70 can be attached to the tooth face 64 of the cutting member 22 by a variety of suitable means. By way of example, and not by way of limitation, the cutter inset 70 can be attached using heating, such as by baking, flame heating, induction brazing or other suitable heating methods. The configuration described above leaves a space of about 1/32 of an inch between the semi-cylindrical attachment surface 77 and the curved tooth face 64 when the tooth face 64 and the cutter inset 70 are in complimentary apposition. This space is provided for being filled when the attachment or connection is formed between these two parts using a connection material or materials.

A variety of materials can be used during the brazing or other method of connecting to form the connection or attachment, and the use of various suitable materials now known or hereafter developed is contemplated by the present invention. In one implementation, silver solder (not shown) is used during the connection process to form the attachment. In another implementation, a tri-metal shim 80 (shown in FIG. 9) is used during the connecting process or processes to form the connection or attachment.

Figure 9:
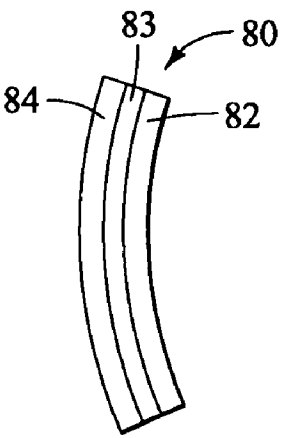
FIG. 9 is a side view showing a preferred tri-metal connection shim used according to one embodiment of the present invention.

FIG. 9 shows a preferred tri-metal shim 80 which includes a first silver solder layer 82, a second or middle copper layer 83, and a third silver solder layer 84. When the tri-metal shim 80 is used, it is applied to either the inset or the cutting face 64 of the cutter using controlled induction brazing or other techniques such as described above. This acts such that the first layer 82 or third layer 84 of the tri-metal shim 80 bonds with the inset or cutting face 64. The middle or second layer 83 is advantageous made of copper and the first layer 82 preferably made of silver solder do not necessarily melt during the connecting process. In operation, the middle copper layer 83 is beneficial by providing improved shock and thermal expansion resistance, along with the bonding function provided by shim 80 or other bonding layer or element.

The complementary relationship between the concave cutter face and convex surface 77 provides improved distribution of forces generated against the inset and supporting cutter. This mating semi-cylindrical connect has been discovered to be superior by the inventor for minimizing break-out of the inset.

Front Portion—Cutter Inset

Referring once again to FIGS. 4-8, with emphasis to FIG. 6, the front portion 73 of the cutter inset 70 is shown to include a cutting face 90. The cutting face 90 is substantially rectangular in shape and is defined in part by first side edge 92, second side edge 93, third or top side edge 94, and fourth or bottom side edge 95. The first and second side edges 92 and 93 define the short sides of the generally rectangular cutting face 90. The third and fourth side edges 94 and 95 define the long sides of the cutting face 90. The first and second side edges 92 and 93 are each about 6/32 of an inch in height as shown by arrow 98. The third and fourth side edges 95 and 95 are each about 10/32 of an inch in length as shown by arrow 99. It should also be noted that the distance from the cutting face 90 to the most distant part or apex 101 of the attachment surface 77 is about 4/32 of an inch in length as shown by arrow 100. The cutting face 90 is generally directed in the running direction as show by arrow 23.

The corners 104 of the cutting face 90 are beveled at a suitable angle. As shown, the beveled corners are angled at 45 degrees relative to the adjacent side edges. For example, the edges 93 and 94 of the inset cutting face have a beveled corner 104. These beveled corners 104 are discussed in more detail below. Alternative forms of providing a smooth non-perpendicular edge may also be workable in some situations, such as rounded or otherwise smoothed where the junction occurs.

Body Portion—Cutter Inset

Referring once again to FIGS. 4-8, the body portion 72 of the cutter inset 70 is further described. The body portion 72 of the cutter inset 70 connects the cutting face 90 of the front portion 72 to the semi-cylindrical attachment surface 77 of the rear portion 71. The body portion 72, rear portion 71 and front portion 73 form a solid structure. The body portion 72 is defined in part by a first side surface 110, a second side surface 111, a third side surface 112, and a fourth side surface 113. These four body surfaces or sides 110, 111, 112, and 113 are joined by chamfered rounded or smoothed edges 120. Each of these four pseudo-corner edges 120 are beveled at about 45 degrees relative to the adjoining sides 110, 111, 112, and 113 as shown by arrows 115 (FIG. 6) or are otherwise appropriately shaped to reduce forces at and near the pseudo-corners. As shown, the chamfers 120 are each about 1/16 of an inch wide in the exemplary sized inset described herein, but may vary dependent on the size of the saw chain cutters to which the insets are being applied. This beveled or smoothed configuration reduces breakage of the cutter inset 70 during operation of the saw chain 20*a*. As shown, the chamfers at these four edges 120 extend rearwardly from cutting face 90. The illustrated design shows them extending substantially between the cutting face 90 of the front portion 73 to or near the curved attachment surface 77 of the rear portion 71.

Figure 8:
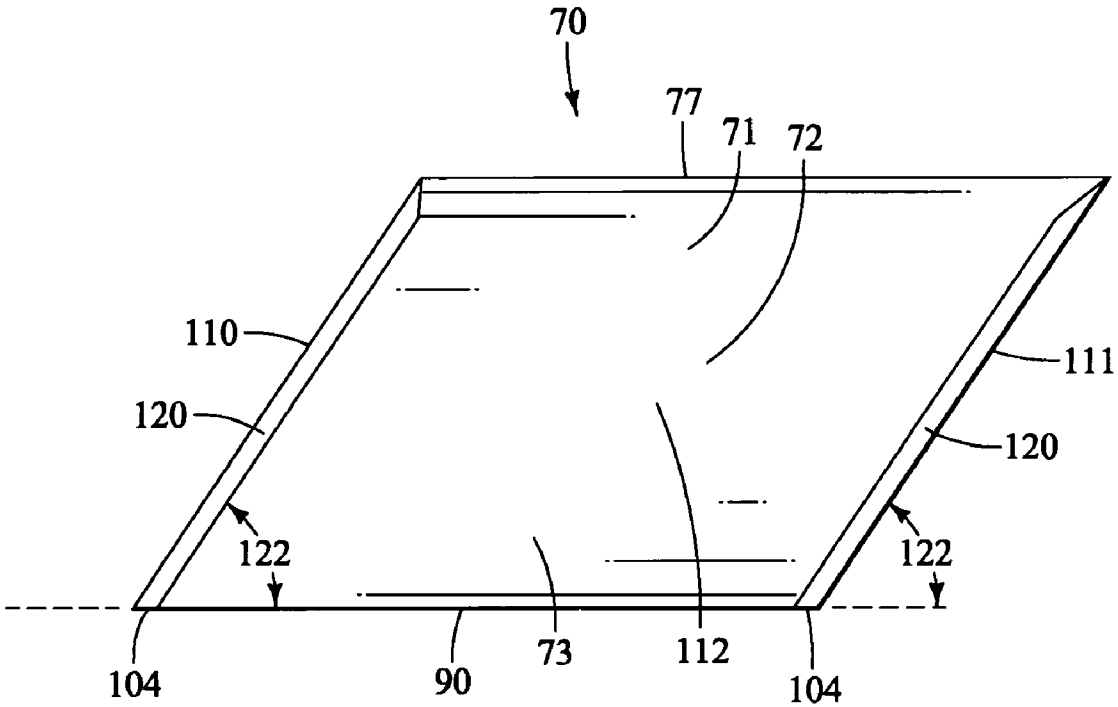
FIG. 8 is a top view showing the cutter element of FIG. 6.

As shown best in FIG. 8, the first and second end sides 110 and 111 are substantially parallel and are each angled at a filing angle of the cutter being fitted with the inset. This allows the ends 110 and 111 to run parallel to the direction of travel of the inset as the saw chain cuts. For example, on cutters have a cutting face filing angle of 35°, the end surfaces are similarly angled at 35° from perpendicular. This corresponds to about 55° relative to the cutting face 90 as shown by arrow 122.

Figure 5:
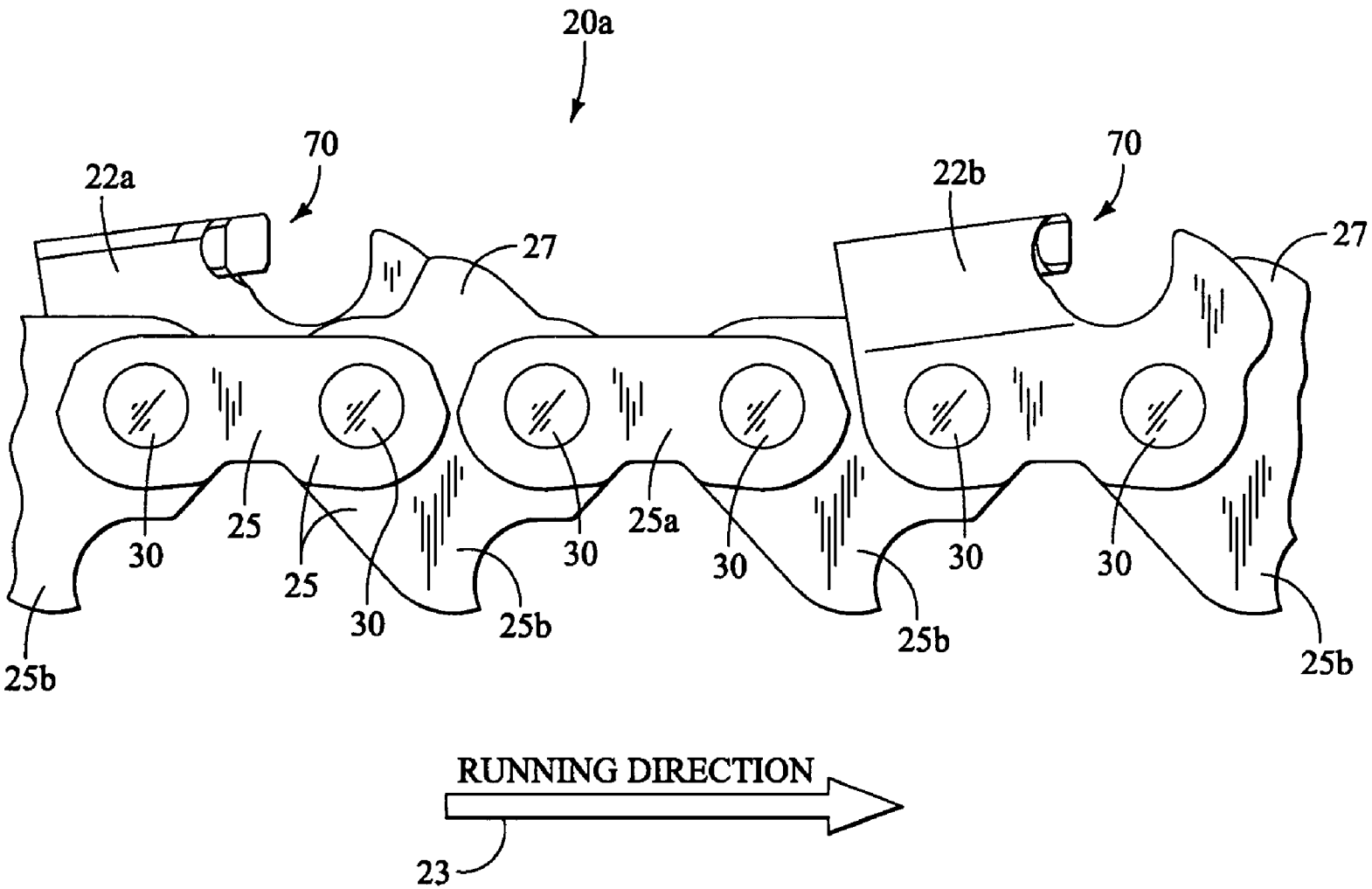
FIG. 5 is a side view showing a segment of saw chain as circled in FIG. 1 according to one embodiment of the present invention.

The cutter inset 70 thus shaped is advantageous in that it can be alternatively attached to either a left-hand saw chain cutting member 22*a* or to a right-hand saw chain cutting member 22*b* (as shown in FIG. 5). This dual use is accomplished by reversing the surfaces which form the top and bottom sides. This configuration of the cutter inset 70 advantageously allows a single configuration of inset 70 to be attached to either the left-hand or right-hand cutting members 22*a* or 22*b*. This configuration simplifies manufacturing since only a single die is needed for forming the insets for a particular type of saw chain. It also facilitates the attachment process, as there is no need for manufacturing and/or separating differently shaped insets for the two different handed cutters.

Cutter Inset Adjustable Rake

In general, the convex inset surface 77 is capable of being adjusted to different angular orientations within the concave receptacle formed by the original filing of the cutter face. The inset can be adjusted from a positive rake to a negative rake. A positive rake positions the inset to lean forward, thus cutting more aggressively. A negative rake positions the inset to lean rearwardly and produces a less aggressive cutting action. The ranges of positive and negative rake angles that are acceptable vary on the material being cut. For example, metal is preferably cut using a negative rake to reduce cutting forces generated at the inset. Softer materials may best be cut using a positive rake. Generally rake angles of ±10° of arc will cover a wide variety of materials. Larger rake angles may be possible with some materials.

The variable rake angle allows a common saw chain to be fitted with the hard insets to meet the user's desires or the needs of the material being cut. For common materials rake angles of ±5° of arc are preferred.

The Modified Saw Chain

Referring now to FIG. 5, an embodiment of the present invention is described as saw chain 20*a*. The modified saw chain 20*a* comprises a conventional saw chain 20 (as shown in FIG. 2), however, one or more cutter insets 70 have been attached to form the modified saw chain 20*a*. As described previously, the conventional saw chain 20 includes a plurality of saw chain cutters 22. Each of the saw chain 20 cutters 22 includes a tooth cutting face 64 (as shown in FIGS. 2 and 3). In the modified saw chain 20*a*, a cutter 2 inset 70 has been attached to the tooth face 64 of at least one of the cutters.

The segment of saw chain 20*a* shown in FIG. 5 includes one left-hand hand cutting member 22*a* and one right-hand cutting member 22*b*. In FIG. 5, each of these cutting members 22*a* and 22*b* have a carbide cutter inset 70 attached to their respective tooth faces 64. Thus, FIG. 5 shows a plurality of cutter insets 70 attached to a saw chain 20, thereby forming the modified saw chain 20*a*.

If one or more of the carbide cutter insets 70 become detached from the saw chain 20*a*, the loss of a cutter inset 70 will not in general render the saw chain 20*a* unusable. If a cutter inset 70 is dislodged from a cutting member 22, the original tooth face 64 will be revealed and made available for cutting. The tooth face 64 which is revealed by the loss of a cutting inset 70 is able to perform cutting functions, even though it may become dulled with continued use.

Methods

Other embodiments of the present invention contemplate methods for attaching the carbide cutter inset 70 to the tooth face 64 of a conventional saw chain 20 cutting member 22. Some of these methods which were briefly discussed above are now described in detail.

In one embodiment, the method includes selecting or otherwise providing a cutter inset 70 of complementary shape along the rear surface thereof to the cutting face 64 of the saw chain. The complementary shapes are preferably semi-cylindrical. The rear surface forms an attachment surface 77.

The selecting also preferably includes using an inset having a front portion 73 including a cutting face 90 which has beveled or smoothed cutting face corners thereon and most preferably beveled or chamfered corner edges, or even more preferably both beveled corners and chamfered corner edges or curved equivalents.

The selecting or providing steps for the insets also may include other preferred configurations, shapes, and sizes as needed for the cutters being fitted with the insets and the desired saw chain sizes and configurations desired.

After providing the carbide cutter inset 70, preferred methods include attaching the cutter inset 70 to the tooth face 64. This is preferably done by brazing, soldering or other forms of welding suitable for the materials being used.

The attaching of inset 70 to cutter face 66 is advantageously done using a shim or layer of connecting material which is capable of bonding or adhering to both the cutter face and the hard material used for the cutter inset 70. In one form of the methods, the shim or layer of connecting material is attached first to the inset. In still other methods according hereto, the cutter, connecting material, and inset are brought into juxtaposition and then joined simultaneously. A further possible approach involves connecting the layer of connecting material to the cutting face semi-cylindrical surface of the cutter.

The attaching may further include heating the parts being attached to a suitable temperature such that the connecting material or material become capable of bonding to the cutter and to the hard inset.

In a further method or methods according to this invention, the connecting material may be applied to the inset attachment surface first. This may be accomplished using suitable connecting materials, such as silver solder, which is heated and applied to the attachment surface. In another form the connecting material may be in the form of a pre-formed shim. The pre-formed shim may be placed upon the attachment surface of the inset and then heated. One preferred manner of connecting the shim or other connecting materials to the attachment surface of the inset is to bake the inset and shim or other connecting material to a suitable temperature to cause the shim, silver solder, or other connecting material to perform by bonding the connecting material to the inset attachment surface prior to connection with the saw chain.

In the methods indicated in the prior paragraph, the heating of the connecting material and inset is performed first. The resulting inset and connection material results in a prepared inset with connection material bonded thereto. The prepared insets may then experience cooling and stockpiling awaiting attachment to the saw chain cutters.

In some of the preferred methods, the heating step may be accomplished using magnetic induction heating. The heating may also be performed by flame heating, baking or other suitable heating techniques.

The present invention contemplates selecting a suitable solder or other connecting material for the connecting or attaching on the insert to the cutter face. In one implementation, silver solder is used in a brazing process to attach the carbide cutter inset 70 to the tooth face 64 of the conventional saw chain 20 cutting member 22. In another implementation, the method includes the use of a shim made of a three layer material, such as tri-metal shim 80 (shown in FIG. 9) to form the attachment. In another form, the selecting may be a shim or layer of other suitable connecting material. The tri-metal shim material is described above.

In some methods according to the invention, after the inset 70 or prepared inset has been attached to the cutter face 64, the process is further performed by repeating the attaching of the insets to all or a plurality of the cutters on the saw chain. In general, no grinding or further processing is needed to the saw chain or insets attached to the cutters. This is a clear advantage over methods which require grinding and/or machining after such an attachment has been made.

The connecting between the inset and cutter may be performed in a manner wherein the insets are provided with the connecting material prior to joinder of the resulting prepared inset to the cutter face. This can be done by baking the silver solder or shim, such as shim 80, onto the attachment surface of the inset. The prepared insets can then be attached to the cutters of the saw chains with the saw chains intact. Alternatively, the insets may be affixed to the cutters and then the saw chain assembled.

EXAMPLE A

The tri-metal shim consists of silver solder copper and then another layer of silver solder. The shim is formed in a die to the outer shape of the cylindrical portion of the carbide insert. It is then attached to the carbide insert by induction welding or baked to a temperature that allows the silver solder to flow only on one side, then cooled. The carbide is then set in a jig manually that holds the carbide in place next to the chassis where it is reheated and welded in place by flame or induction welding (gas).

EXAMPLE B

The tri-metal shim consists of silver solder, copper, and then another layer of silver solder. The shim is formed in a die to the outer shape of the cylindrical portion of the carbide insert. It is then attached to the carbide insert by induction welding or baked to a temperature that allows the silver solder to flow only on one side, then cooled. The carbide pieces are put in a vibratory shaker and sorted where they then slide down into a fixture that holds the carbide in place next to the chain chassis and heated by means of induction welding or flame welding (gas). The chain automatically advances to the next position and the next piece of carbide is indexed into place and welded.

The carbide inserts are set in place by a mechanical means in which it is automated and does not require any application of manual labor.

Interpretation Note

The invention has been described in language directed to the current embodiments shown and described with regard to various structural and methodological features. The scope of protection as defined by the claims is not intended to be necessarily limited to the specific features shown and described. Other forms and equivalents for implementing the inventions can be made without departing from the scope of concepts properly protected hereby.

I claim:

1. A cutter inset for use in a saw chain, comprising:

a front face having an elongated approximately rectangular cutting face;

body side surfaces extending rearwardly from said front face to provide added depth of the cutter insert for strength; said body side surfaces including end surfaces along ends of the cutter inset which are obliquely angled relative to the front face to provide end surfaces which are approximately parallel and oblique such that the end surfaces will move in a direction of travel whereas the front face is angled relative to the direction of travel, wherein each body side surface is defined by two parallel opposed edges and an arcuate edge connected to the two parallel opposed edges;

a rear face having a semi-cylindrical shape for engagement into a semi-cylindrical receptacle of a saw tooth link;

chamfered corners along the front face and at least portions of said body side surfaces to reduce the risk of breakage of the inset at the corners and having said body side surfaces extending rearward from the front face along the sides of the cutter inset;

whereby the shape of the cutter inset provides a depth from the front face which extends rearward between the front face and the rear face.

2. A cutter inset according to claim 1 wherein the cutter inset is made from a hardened material.

3. A cutter inset according to claim 1 wherein the cutter inset is made from a hardened material including a carbide.

4. A cutter inset according to claim 1 wherein the cutter inset is made from a hardened material including tungsten carbide.

5. A cutter inset according to claim 1 wherein the cutter inset is made from a hardened material made of a cemented carbide. tungsten carbide material having a cobalt binder.

6. An apparatus comprising a saw chain cutter link for use in a chain saw, comprising:

a body;

a front linking feature formed in a frontal portion of the body for connecting to the cutter link to a different link of the chain saw;

a rear linking feature formed in a rearward portion of the body for connecting to the cutter link to a different link of the chain saw;

a gullet between the frontal portion and rearward portion of the body of the cutter link;

said rearward portion having a side plate portion and a transversely oriented top plate portion;

a semi-cylindrical receptacle formed across the rearward portion toward the gullet;

an inset having:

a front face having an elongated approximately rectangular cutting face;

body side surfaces extending rearwardly from said front face to provide added depth of the cutter insert for strength; said body side surfaces including end surfaces along ends of the cutter inset which are obliquely angled relative to the front face to provide end surfaces which are approximately parallel and oblique such that the end surfaces will move in a direction of travel whereas the front face is angled relative to the direction of travel, wherein each body side surface is defined by two parallel opposed edges and an arcuate edge connected to the two parallel opposed edges;

a rear face having a semi-cylindrical shape for engagement into a semi-cylindrical receptacle of a saw tooth link;

chamfered corners along the front face and at least portions of said body side surfaces to reduce the risk of breakage of the inset at the corners and having said body side surfaces extending rearward from the front face along the sides of the cutter inset;

whereby the shape of the cutter inset provides a depth from the front face which extends rearward between the front face and the rear face.

7. An apparatus according to claim 6 wherein the cutter inset is made from a hardened material.

8. An apparatus according to claim 6 wherein the cutter inset is made from a hardened material including a carbide.

9. An apparatus according to claim 6 wherein the cutter inset is made from a hardened material including tungsten carbide.

10. An apparatus according to claim 6 wherein the cutter inset is made from a hardened material made of a cemented carbide.

11. An apparatus comprising a chain saw having at least one saw chain cutter link therein, comprising:

a body;

a front linking feature formed in a frontal portion of the body for connecting to the cutter link to a different link of the chain saw;

a rear linking feature formed in a rearward portion of the body for connecting to the cutter link to a different link of the chain saw;

a gullet between the frontal portion and rearward portion of the body of the cutter link;

said rearward portion having a side plate portion and a transversely oriented top plate portion;

a semi-cylindrical receptacle formed across the rearward portion toward the gullet;

an inset having:

a front face having an elongated approximately rectangular cutting face;

body side surfaces extending rearwardly from said front face to provide added depth of the cutter insert for strength; said body side surfaces including end surfaces along ends of the cutter inset which are obliquely angled relative to the front face to provide end surfaces which are approximately parallel and oblique such that the end surfaces will move in a direction of travel whereas the front face is angled relative to the direction of travel wherein each body side surface is defined by two parallel opposed edges and an arcuate edge connected to the two parallel opposed edges;

a rear face having a semi-cylindrical shape for engagement into a semi-cylindrical receptacle of a saw tooth link;

chamfered corners along the front face and at least portions of said body side surfaces to reduce the risk of breakage of the inset at the corners and having said body side surfaces extending rearward from the front face along the sides of the cutter inset;

whereby the shape of the cutter inset provides a depth from the front face which extends rearward between the front face and the rear face.

12. An apparatus according to claim 11 wherein the cutter inset is made from a hardened material.

13. An apparatus according to claim 11 wherein the cutter inset is made from a hardened material including a carbide.

14. An apparatus according to claim 11 wherein the cutter inset is made from a hardened material including tungsten carbide.

15. An apparatus according to claim 11 wherein the cutter inset is made from a hardened material made of a cemented carbide.

* * * * *